United States Patent [19]

Schmidt

[11] Patent Number: 4,458,223

[45] Date of Patent: Jul. 3, 1984

[54] MICROWAVE WINDOW ASSEMBLY HAVING COOLING MEANS

[75] Inventor: Wolfgang Schmidt, Hamburg, Fed. Rep. of Germany

[73] Assignee: U.S. Philips Corporation, New York, N.Y.

[21] Appl. No.: 535,535

[22] Filed: Sep. 23, 1983

Related U.S. Application Data

[63] Continuation of Ser. No. 286,948, Jul. 27, 1981, abandoned.

[30] Foreign Application Priority Data

Jul. 26, 1980 [DE] Fed. Rep. of Germany ..... 3028461

[51] Int. Cl.³ ..... H01P 1/08

[52] U.S. Cl. ..... 333/252; 333/254

[58] Field of Search ..... 333/252; 315/39.53

[56] References Cited

U.S. PATENT DOCUMENTS 3,101,461 8/1963 Henry-Bezy et al. ..... 333/252

3,936,779 2/1976 Achter et al. ..... 333/252

*Primary Examiner*—Paul L. Gensler

*Attorney, Agent, or Firm*—Robert J. Kraus

[57] ABSTRACT

A microwave window assembly has a ceramic window (12) with a thickness of more than 10 mm, corresponding to a half wavelength of the microwave energy. The window (12) has a metallized side surface and is connected by means of a soldered joint to a frame (11). The frame (11) is constructed in two parts (11A, 11B) which are soldered to respective edge parts (10A, 10B) of the side surface of the window, while the side surface between the two parts (11A, 11B) of the frame is covered with a layer (13) electrically connecting the two frame parts (11A, 11B).

9 Claims, 3 Drawing Figures

MICROWAVE WINDOW ASSEMBLY HAVING COOLING MEANS

This is a continuation of application Ser. No. 286,948, filed July 27, 1981, now abandoned.

BACKGROUND OF THE INVENTION

The invention relates to a microwave window assembly having a ceramic microwave window, which window has a thickness of more than 10 mm and comprises a metallized side surface which is soldered in a vacuum-tight manner in a frame which is exposed to a coolant.

The invention further relates to a microwave tube having such a microwave window assembly. Windows of this type serve in particular for coupling out high frequency power from vacuum tubes, for example klystrons, which is then transported via wave guides.

The high-frequency windows having a thickness of more than 10 mm are windows in which the required impedance matching between the window and the wave guide is achieved by choosing the thickness of the window so as to be equal to half a wavelength at the frequency to be transmitted in the material of the window, that is to say equal to $(\lambda o/2)\cdot(1/\sqrt{\epsilon})$. This proportioning leads to a 1:1 impedance transformation and thus neutralizes the disturbing influence of the material of the window to a very considerable extent.

The cooling area at the side surface of the window is proportional to the thickness of the window and a thick-walled $\lambda/2$ window can transmit high powers. A high-frequency window of this type is known for example, from U.S. Pat. No. 3,993,969. In this Patent the connection between the window and the frame is produced via a metallization zone and soldering zone which have a large area and cover the whole side surface of the window.

It is extremely difficult to produce metal-to-ceramic bonds with a large bonding area in a reliable manner. For this reason $\lambda/2$ windows have so far been constructed in thicknesses limited to about 15 mm. The technological difficulty in providing solder joints for larger thickness windows restricts the use of $\lambda/2$ windows to frequencies of approximately 3 GHz and higher.

Although the ceramic material normally used for the windows has high thermal conductivity, heat flow to the coolant (water, oil or air) is impeded by the transition zone of the metal-to-ceramic bond which has low thermal conductivity. The impediment to heat transfer in the connection zones between the window and the frame causes a large temperature gradient and correspondingly high thermal stresses, possibly resulting in an inadmissibly high mechanical load of the bond between the window and the frame.

SUMMARY OF THE INVENTION

It is an object of the invention to provide a microwave assembly of the kind mentioned in the opening paragraph which can be constructed with a window thicker than 10 mm and in which temperature gradients giving rise to detrimental mechanical stresses do not take place at high loads.

In accordance with the invention the frame is constructed in two parts which are each soldered at a respective edge of the side surface of the window and the side surface of the window between the two parts of the frame is covered with a conductive layer which electrically connects the two parts of the frame.

Since the frame consists of two parts which are each soldered only to an edge of the side surface of the window, only narrow soldering zones are necessary which can be reliably made.

By covering the side surface of the window between the two parts of the frame with a conductive layer, the necessary electrical outer jacket for the window is formed, while in addition nearly the whole side surface of the window is directly exposed to the coolant so that heat transfer between the window and the frame is not impeded.

In a preferred embodiment the edges of the side surface have recesses in which the frame parts engage and the radial depth of each recess is approximately equal to the thickness of the respective frame part. The axial depth of each recess is preferably approximately 2 to 6 mm.

In order to improve cooling the side of the window may be configured such that its surface area, between the two parts of the frame is increased.

In the preferred embodiment, the window consists of ceramic material and the frame consists of an iron-nickel-cobalt alloy or a nickel-copper alloy. The side surface of the window which is soldered at its edges to the parts of the frame is covered with at least one metal layer which is a good electrical and thermal conductor and which can withstand the coolant. The thickness of the metal layer(s) corresponds to approximately twice the depth of penetration of the current at the frequency of the microwave energy transmitted. Suitable metals for this (these) layer(s) are gold, silver and copper.

The window may be constructed as a $\lambda/2$ window. That is, the thickness of the window is $(\lambda o/2)\cdot(1/\sqrt{\epsilon})$, where $\lambda_o$ is the wavelength at the average frequency to be transmitted and $\epsilon$ is the dielectric constant of the material of the window.

BRIEF DESCRIPTION OF THE DRAWING

Embodiments of the invention will now be described in greater detail by way of example with reference to the accompanying drawing, in which.

DESCRIPTION OF THE PREFERRED EMBODIMENTS

Figure 1:
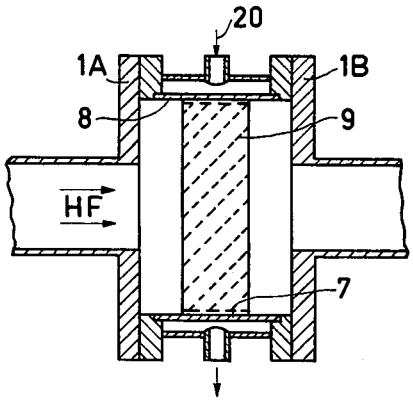
FIG.1 PRIOR ART
FIG. 1 is a microwave window assembly having a thick window according to the prior art.

FIG. 1 shows a known high frequency window which is provided between a waveguide 1*a* and a waveguide 1*b*. The window 9 is soldered to a frame 8 over its whole side surface 7. The coolant supplied at 20 thus covers the outer surface of the frame 8.

As already described above, in addition to the disadvantage that such a connection between the window 9 and the frame 8 is possible only with comparatively thin windows (<15 mm), this construction has the additional disadvantage that a temperature gradient can easily be formed at the transition from the window to the frame and may lead to unfavourable mechanical stresses.

Figure 2A:
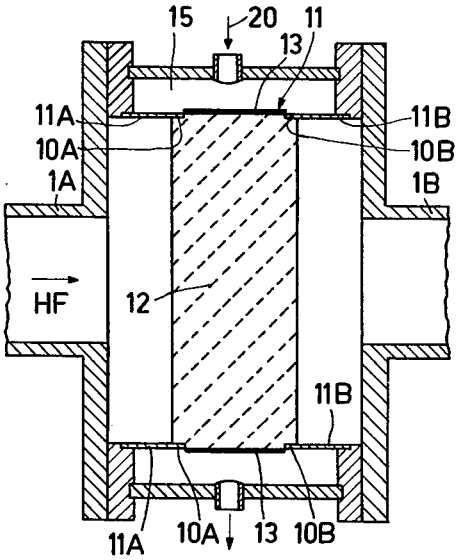
FIG. 2*a* is a microwave window assembly according to the invention.

FIG. 2*a* shows a microwave window assembly constructed according to the invention which is also provided between a waveguide 1A and a waveguide 1B.

Figure 2B:
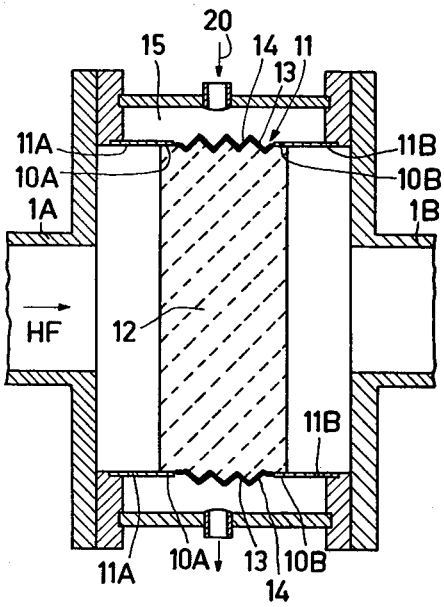
FIG. 2*b* is another embodiment of a microwave window assembly according to the invention.

The waveguide 1A may be connected to the output of a microwave tube such as a klystron (not shown in the drawing). The window 12 is not provided in a frame forming one assembly but in a frame 11 consisting of two parts 11A, 11B each soldered to edges 10A, 10B, respectively, of the side surface of the window 12. As shown in FIG. 2*b* the frame parts may bear on the side surface of the window 12 or as shown in FIG. 2*a* they may engage in recesses 10A, 10B. The depth of the recesses, viewed in the radial direction, is chosen to be approximately equal to the thickness of the frame parts 11A and 11B, respectively, engaging therein. The depth of the recesses in the axial direction is approximately 2 to 6 mm. This means that the connection surface between the window 12 and the frame 11A, 11B is so small that the soldered joint can be reliably made.

Between the two frame parts 11A and 11B the side surface of the window 12 is covered with a conductive layer 13 which consists, for example, of copper and connects the two frame parts together electrically and has a thickness which is approximately twice as large as the depth of penetration of the current at the frequency to be transmitted. At frequencies around approximately 1000 MHz the required layer thickness is approximately 20 to 30 μm, corresponding to a depth of penetration of the current of approximately 10 to 15 μm. A hollow space 15 is formed around the frame and the side surface of the window for carrying a coolant supplied at 20. This coolant, for example water, oil or air, is in direct contact with the greater part of the side surface of the window 12, and no undesired temperature gradient can develop between the window and the coolant. In order to increase the cooling effect, as shown in FIG. 2*b* the part of the side of the window extending between the two frame parts 11A and 11B may be configured to maximize the surface area. When this surface is in the form of V-shaped grooves 14 having an apical angle of 90° the cooling surface is increased by a factor $\sqrt{2}$ and hence the thermal energy which can be dissipated is increased by approximately 40%. The higher heat developed as a result of the longer current path in the conductive layer 13 is also dissipated by the direct contact with the coolant, preventing a rise in temperature at the window or at the connection between the window and the frame.

Due to the effective cooling at the side surface of the window 12 and due to the considerable strength of the connection between the window 12 and the frame parts 11A and 11B very high microwave power can be transmitted through the window in either a pulsating or a continuous manner. A large power capability is achieved because of the comparatively high thermal capacity and the intensive cooling of the window 12, in particular for pulsating operation with pulses in the millisecond or second range having a low recurrent frequency.

The total side surface of the window 12 is covered with at least one metal layer by conventional metallization methods prior to the connection of the two frame parts 11A and 11B. The part of the side surface not to be connected to the frame parts, that is the part extending between the soldering zones, is galvanically reinforced. The metal or metals used for this purpose must be electrically and thermally conductive and must be capable of withstanding the coolant. During the soldering process for producing the bond between the two frame parts and the window, the metal layer is post-sintered with a corresponding concentration of the metal and hence an increase of electrical conductivity.

A suitable material for the window 12 is a ceramic material which contains more than 97% of $Al_2O_3$ or BeO. An iron-nickel-cobalt alloy may be used for the frame parts 11A and 11B. The comparatively low thermal conductivity of this material is not detrimental because, as already explained, the cooling of the window 12 takes place by the direct contact of the coolant with the central part of the side surface of the window.

What is claimed is:

1. A microwave window assembly for closing openings in first and second waveguides while enabling the transmission of microwave energy from one waveguide to the other, said assembly comprising:

a. a window of microwave permeable material having first and second opposing faces adjacent the openings in the first and second waveguides, respectively, and a circumferential side extending between said faces;

b. an electrically and thermally conductive layer on the circumferential side;

c. a first electrically conductive frame member attaching the first face to the first waveguide, one end of said member framing said first face and being soldered to the conductive layer at an edge of the layer near said first face, and an opposite end of said member framing the opening in the first waveguide and being hermetically and electrically connected to the first waveguide, said first frame member cooperating with said first face to seal the opening in the first waveguide;

d. a second electrically conductive frame member attaching the second face to the second waveguide, one end of said member framing said second face and being soldered to the conductive layer at an edge of the layer near said second face, and an opposite end of said member framing the opening in the second waveguide and being hermetically and electrically connected to the second waveguide, said second frame member cooperating with said second face to seal the opening in the second waveguide; and e. means for directing a coolant against the conductive layer;

said conductive layer providing electrical continuity from one frame member to the other and facilitating heat transfer from the window to said coolant.

2. A microwave window assembly as in claim 1 characterized in that the window includes a recess formed at an edge where one face meets the circumferential side, the respective frame member engaging the window in said recess.

3. A microwave window assembly as in claim 2 characterized in that the recess has a radial depth approximately equal to the frame member's thickness and an axial depth of approximately 2–6 mm.

4. A microwave window assembly as in claim 1, 2 or 3 characterized in that the circumferential side of the window is grooved to increase the surface area thereof.

5. A microwave window assembly as in claim 1, 2 or 3 characterized in that the frame members are composed essentially of an alloy selected from the group consisting of iron-nickel-cobalt and nickel-copper.

6. A microwave window assembly as in claim 1, 2 or 3 characterized in that the thickness of the conductive layer is approximately twice the depth of penetration of electrical current into the layer at the operative microwave frequency of the waveguide.

7. A microwave window assembly as in claim 1, 2 or 3 characterized in that the conductive layer is composed essentially of a metal selected from the group consisting of gold, silver and copper.

8. A microwave window assembly as in claim 1, 2 or 3 characterized in that the thickness of the window is $(\lambda_0/2)\cdot(1/\sqrt{\epsilon})$, where $\lambda_0$ is the wavelength corresponding to the average frequency of operation of the waveguide and $\epsilon$ is the dielectric constant of the window material.

9. A microwave tube including an output waveguide and a microwave window assembly for closing respective openings in said output waveguide, and a second waveguide, while enabling transmission of microwave energy through said openings, said window assembly comprising:

a. a window of microwave permeable material having first and second opposing faces adjacent the openings in the output and second waveguides, respectively, and a circumferential side extending between said faces;

b. an electrically and thermally conductive layer on the circumferential side;

c. a first electrically conductive frame member attaching the first face to the output waveguide, one end of said member framing said first face and being soldered to the conductive layer at an edge of the layer near said first face, and an opposite end of said member framing the opening in the output waveguide and being hermetically and electrically connected to the output waveguide, said first frame member cooperating with said first face to seal the opening in the output waveguide;

d. a second electrically conductive frame member for attaching the second face to the second waveguide, one end of said member framing said second face and being soldered to the conductive layer at an edge of the layer near said second face, and an opposite end of said member being adapted for framing the opening in the second waveguide and for being hermetically and electrically connected to the second waveguide, said second frame member cooperating with said second face to seal the opening in the second waveguide; and e. means for directing a coolant against the conductive layer;

said conductive layer providing electrical continuity from one frame member to the other and facilitating heat transfer from the window to said coolant.

* * * * *